US012660877B2

(12) United States Patent
Andrews et al.

(10) Patent No.: US 12,660,877 B2
(45) Date of Patent: Jun. 23, 2026

(54) APPARATUS AND METHOD OF MANUFACTURING MULTI-PIECE CLOSED-BACK ISOLATION GARMENTS

(71) Applicant: Curt G. Joa, Inc., Sheboygan Falls, WI (US)

(72) Inventors: Robert E. Andrews, Falmouth, MA (US); Samuel E. Darcy, Cleveland, WI (US); Scott A. Roehrborn, Sheboygan, WI (US); Jeffrey W. Fritz, Plymouth, WI (US); Mark E. Justice, Powell, TN (US); Samuel Griffin, New Tazewell, TN (US)

(73) Assignee: CURT G. JOA, INC., Sheboygan Falls, WI (US)

( * ) Notice: Subject to any disclaimer, the term of this patent is extended or adjusted under 35 U.S.C. 154(b) by 121 days.

(21) Appl. No.: 18/564,506

(22) PCT Filed: May 24, 2022

(86) PCT No.: PCT/US2022/030778
§ 371 (c)(1),
(2) Date: Nov. 27, 2023

(87) PCT Pub. No.: WO2022/251256
PCT Pub. Date: Dec. 1, 2022

(65) Prior Publication Data

US 2024/0285012 A1 Aug. 29, 2024

Related U.S. Application Data

(60) Provisional application No. 63/202,109, filed on May 27, 2021.

(51) Int. Cl.
*A41H 42/00* (2006.01)
*A41D 13/12* (2006.01)

(52) U.S. Cl.
CPC ..... *A41H 42/00* (2013.01); *A41D 13/12* (2013.01)

(58) Field of Classification Search
CPC .... A41H 42/00; A41D 13/12; A41D 13/1209; A41D 13/1245
See application file for complete search history.

(56) References Cited

U.S. PATENT DOCUMENTS

D95,456 S 4/1935 Rosen
3,639,915 A 2/1972 Hrubecky
(Continued)

FOREIGN PATENT DOCUMENTS

CN 203762331 U 8/2014
CN 206365518 U 8/2017
(Continued)

OTHER PUBLICATIONS

International Search Report and Written Opinion issued in corresponding PCT Application No. US2022/030778, issued Sep. 20, 2022.

(Continued)

*Primary Examiner* — S. Behrooz Ghorishi
(74) *Attorney, Agent, or Firm* — Quarles & Brady, LLP

(57) ABSTRACT

An apparatus for executing a method of manufacturing multi-piece closed-back isolation garments (410) includes machinery for creating discrete torso web pieces (412) from a continuous torso web, combining the discrete torso pieces with a continuous shoulder web (414) having neck openings (444) therein, and cutting the combined torso and shoulder web structure to form the isolation garments. The isolation garments may be used as protection from potentially hazardous or unclean materials in a variety of different environments.

20 Claims, 4 Drawing Sheets

(56) References Cited

U.S. PATENT DOCUMENTS

| | | | |
|---|---|---|---|
| 3,699,591 | A | 10/1972 | Breitkopf et al. |
| 3,719,955 | A | 3/1973 | Hrubecky |
| 3,720,957 | A | 3/1973 | Patience |
| D236,293 | S | 8/1975 | Banks |
| 3,911,499 | A | 10/1975 | Benevento et al. |
| 4,052,752 | A | 10/1977 | Green |
| 4,382,303 | A | 5/1983 | Lunt |
| 4,535,481 | A | 8/1985 | Larson et al. |
| 4,608,719 | A | 9/1986 | Lunt |
| 4,646,365 | A | 3/1987 | Suprise |
| 4,829,602 | A | 5/1989 | Harreld et al. |
| 4,837,860 | A | 6/1989 | Roberts |
| 5,025,501 | A | 6/1991 | Dillon |
| 5,367,710 | A | 11/1994 | Karmin |
| 6,378,136 | B2 | 4/2002 | Matsushita |
| 6,830,543 | B2 | 12/2004 | Alberts et al. |
| D533,982 | S | 12/2006 | Graneto |
| 7,203,974 | B2 | 4/2007 | Jones et al. |
| D598,638 | S | 8/2009 | Graneto |
| D622,934 | S | 9/2010 | Graneto |
| 7,971,274 | B2 | 7/2011 | Graneto |
| D736,493 | S | 8/2015 | Pasko |
| D741,044 | S | 10/2015 | Pasko |
| 9,357,806 | B2 | 6/2016 | Terrell |
| D774,729 | S | 12/2016 | Pasko |
| D779,155 | S | 2/2017 | Pasko et al. |
| D779,156 | S | 2/2017 | Pasko |
| D785,284 | S | 5/2017 | Pasko |
| D787,780 | S | 5/2017 | Pasko et al. |
| D791,434 | S | 7/2017 | Pasko |
| D792,056 | S | 7/2017 | Reese et al. |
| 10,117,470 | B2 | 11/2018 | Reese et al. |
| D836,297 | S | 12/2018 | Pasko |
| 10,299,521 | B2 | 5/2019 | Wolf et al. |
| D863,727 | S | 10/2019 | Pasko |
| 10,441,011 | B2 | 10/2019 | Pasko et al. |
| 10,470,504 | B2 | 11/2019 | Pasko et al. |
| 10,470,506 | B2 | 11/2019 | Pasko |
| 10,835,423 | B2 | 11/2020 | Long et al. |
| 10,986,882 | B2 | 4/2021 | Johnson |
| 2001/0032346 | A1 | 10/2001 | Matsushita et al. |
| 2013/0091615 | A1 | 4/2013 | Pasko et al. |
| 2013/0191960 | A1 | 8/2013 | Pasko |
| 2013/0276204 | A1 | 10/2013 | Pasko et al. |
| 2013/0318682 | A1 | 12/2013 | Graneto, III |
| 2016/0066631 | A1 | 3/2016 | Pasko |
| 2018/0192713 | A1 | 7/2018 | Genender et al. |
| 2018/0213858 | A1 | 8/2018 | Malczyk |
| 2018/0296862 | A1 | 10/2018 | Johnson |
| 2018/0311514 | A1 | 11/2018 | Johnson |
| 2018/0343940 | A1 | 12/2018 | Genender et al. |
| 2019/0283389 | A1 | 9/2019 | Middlesworth |
| 2021/0008396 | A1 | 1/2021 | Johnson |
| 2021/0128366 | A1 | 5/2021 | Schneider |
| 2021/0169158 | A1 | 6/2021 | Mithani et al. |
| 2022/0087348 | A1 | 3/2022 | Terry et al. |
| 2023/0404197 | A1 | 12/2023 | Hagelqvist |
| 2024/0251890 | A1 | 8/2024 | Andrews et al. |
| 2024/0268500 | A1 | 8/2024 | Andrews et al. |
| 2024/0285005 | A1 | 8/2024 | Andrews et al. |

FOREIGN PATENT DOCUMENTS

| | | | | |
|---|---|---|---|---|
| CN | 208286439 | U | 12/2018 | |
| CN | 109862797 | A | 6/2019 | |
| CN | 209090119 | U | 7/2019 | |
| CN | 111513402 | A1 | 8/2020 | |
| CN | 109171072 | B1 | 9/2020 | |
| DE | 102011016497 | A1 | 10/2012 | |
| DE | 202014103297 | U1 | 7/2014 | |
| DE | 102015121421 | A1 | 4/2017 | |
| EP | 490674 | | 10/1996 | |
| EP | 2433601 | B1 | 5/2016 | |
| FR | 2171386 | A * | 9/1973 | ..... A41D 13/1236 |
| FR | 2171386 | A1 | 9/1973 | |
| GB | 1352132 | A | 5/1974 | |
| KR | 20110027385 | A | 3/2011 | |
| KR | 2018012183 | A | 2/2018 | |
| KR | 102023620 | B1 | 9/2019 | |
| VN | 10022433 | B1 | 5/2020 | |
| WO | 2022251075 | A1 | 12/2022 | |
| WO | 2022251256 | A1 | 12/2022 | |
| WO | 2022251260 | A1 | 12/2022 | |
| WO | 2022260858 | A1 | 12/2022 | |

OTHER PUBLICATIONS

McKesson, "Endoscopy Procedure Gown X-Large Blue NonSterile AAMI Level 3 Disposable", (2021) https://mms.mckesson.com/product/841166/Welmed-9100-220XL.

McKesson, "Over-the-Head Protective Procedure Gown TIDIShield® One Size Fits Most Light Blue Non Sterile Disposable", (2021) https://mms.mckesson.com/product/820822/Tidi-Products-8575.

Molnlycke, "Barrier surgical gown Classic Urology", (Jun. 22, 2021) https://www.molnlycke.sg/products-solutions/barrier-surgical-gown-classic-urology/.

Welmed, "Thumb Loop Isolation Gown, Universal, Blue, Thumb Loop Wrists", (2021) https://welmed.us/infection-prevention/protective-apparel/isolation-gowns/thumb-loop-isolation-gown-universal-blue-thumb-loop-wrists/.

* cited by examiner

APPARATUS AND METHOD OF MANUFACTURING MULTI-PIECE CLOSED-BACK ISOLATION GARMENTS

CROSS REFERENCE TO RELATED APPLICATION

This application is the U.S. National Stage of PCT/US2022/030778 with international filing date of May 24, 2022, and which claims priority to U.S. Provisional Application No. 63/202,109 filed on May 27, 2021, the contents of which are incorporated by reference in their entireties.

BACKGROUND OF THE INVENTION

Embodiments of the present invention relate to isolation garments and, more particularly, to multi-piece closed-back/tube-style isolation garments.

Isolation garments are useful in protecting the individuals wearing them from hostile environments. For example, hospital staff, patients, and visitors may wear isolation garments to avoid exposure to blood, other body fluids, and infectious materials or to protect patients, especially those with weakened immune systems, from infection. Also, individuals working in industrial facilities may wear isolation garments to prevent contact with hazardous chemicals. However, isolation garments may be worn in other conditions as well, especially in light of requirements imposed by some jurisdictions to prevent exposure to coronavirus disease 2019 (COVID-19). As an example, hair dressers or barbers may be required to wear isolation garments during their appointments.

Manufacturers produce isolation garments using a variety of different methods. In one method, an automated system combines material webs to construct a portion of an isolation garment. However, the product produced by the automated system does not include sleeves and is not folded. Thus, the isolation garment is finished by hand, with sleeves being sown onto the initial product and then folded for packaging. This method results in a slow production speed and involves a high level of manual labor input.

Another method involves producing isolation garments using a sequential or non-continuous operation. That is, cutting the material webs, combining the webs, and folding of the webs are all performed at different stations. Therefore, the isolation garments must be constantly transferred between the stations in their various stages of production. Further, the combining of the webs and the folding and packaging of the resulting isolation garment is performed by hand. As such, this method is also slow and requires much manual labor.

Still another method that involves a high degree of manual input is one in which an individual cuts the shape of an isolation garment out of one material web or out a stack of material webs. The rest of the material web is discarded as scrap. Thereafter, the material webs are bonded, folded, and packaged manually. The end result is a plurality of isolation garments produced by a slow, manual method that produces a large amount of wasted raw material.

It would therefore be desirable to provide an apparatus and method of manufacturing isolation garments that can produce isolation garments quickly and do not depend on a high level of manual input or result in a large amount of raw material scrap.

BRIEF STATEMENT OF THE INVENTION

In accordance with one aspect of the invention, an apparatus for manufacturing multi-piece closed-back isolation garments includes a slitting unit configured to cut and separate a continuous cover strip segment from a continuous shoulder web, at least one die unit configured to cut a neck opening in the continuous shoulder web, and a first folding unit configured to fold a second shoulder web panel of a continuous shoulder web over a first shoulder web panel of the continuous shoulder web and create an area on the first shoulder web panel that is uncovered by the second shoulder web panel. The apparatus further includes a first bonding unit configured to bond the first shoulder web panel to the second shoulder web panel, a first adhesive applicator configured to apply a first adhesive strip to the uncovered area of the first shoulder web panel, and a perforation unit configured to cut a perforation line in a continuous torso web to define a first tie strap. In addition, the apparatus includes a second folding unit configured to fold the continuous torso web into a tube, a cutting unit configured to cut a torso web piece from the folded continuous torso web, and a transfer unit configured to transfer a torso web piece having a substantially tubular shape onto the first adhesive strip. The apparatus also includes a second adhesive applicator configured to apply a second adhesive strip to attach the continuous cover strip segment to the torso web piece and second shoulder web panel and forming a continuous isolation garment web and at least one other adhesive applicator configured to attach a second tie strap to the torso web piece of the continuous isolation garment web.

In accordance with another aspect of the invention, a method of manufacturing multi-piece closed-back isolation garments includes slitting a continuous cover strip segment from a continuous shoulder web using a slitting unit, cutting neck openings in the continuous shoulder web using a die unit, and overlapping first and second shoulder web panels of the continuous shoulder web to create an area in the first shoulder web panels that is uncovered by the second shoulder web panel. Furthermore, the method includes bonding the first and second shoulder web panels with a first bonding unit, applying a first adhesive strip on the continuous shoulder web in the uncovered area of the first shoulder web panel, and cutting a perforation line in the continuous torso web to define an integrated continuous tie strap. The method also includes folding a continuous torso web to form a tube, cutting a torso web piece from the folded continuous torso web, and transferring, with a transfer unit, a torso web piece having a substantially tubular shape onto the first adhesive strip such that a top edge of the torso web piece overlaps the bottom edge of the first shoulder web panel. Additionally, the method includes attaching the continuous cover strip segment to the torso web piece and second shoulder web panel with a second adhesive strip to form a continuous isolation garment web and adhesively attaching a second tie strap to the torso web piece of the continuous isolation garment web.

Various other features and advantages of the present invention will be made apparent from the following detailed description and the drawings.

BRIEF DESCRIPTION OF THE DRAWINGS

The drawings illustrate embodiments presently contemplated for carrying out the invention.

In the drawings.

DETAILED DESCRIPTION

Embodiments of the present invention provide for an apparatus and method of manufacturing multi-piece closed-back/tube-style isolation garments. In executing the method of manufacturing, the apparatus utilizes a series of cutting, folding, bonding, and transfer units. These units operate together to create torso web pieces from at least one continuous torso web, combine the discrete torso pieces with a continuous shoulder web, and cut and fold the combined torso and shoulder web structure to form the multi-piece closed-back isolation garments, and fold or roll up the multi-piece closed-back isolation garments for packaging. The multi-piece closed-back isolation garments may be used in a variety of environments such as, for example, as isolation gowns in medical environments, as an alternative to coveralls in industrial environments, and any other environments in which isolation from potentially hazardous or unclean materials or other individuals is desired. Thus, while referred to hereafter as "isolation gowns", it is contemplated that the garments described herein may be manufactured for use outside of the healthcare industry.

Figure 2:
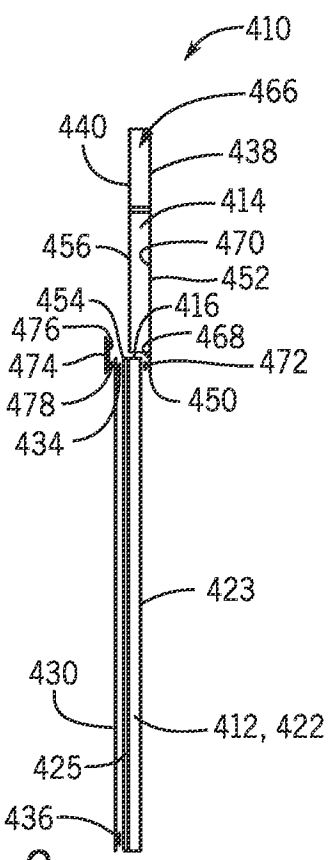
FIGS. 1-3 are rear, right side, and rear perspective views of a multi-piece closed-back/tube-style isolation garment, according to embodiment of the invention.
Figure 1:
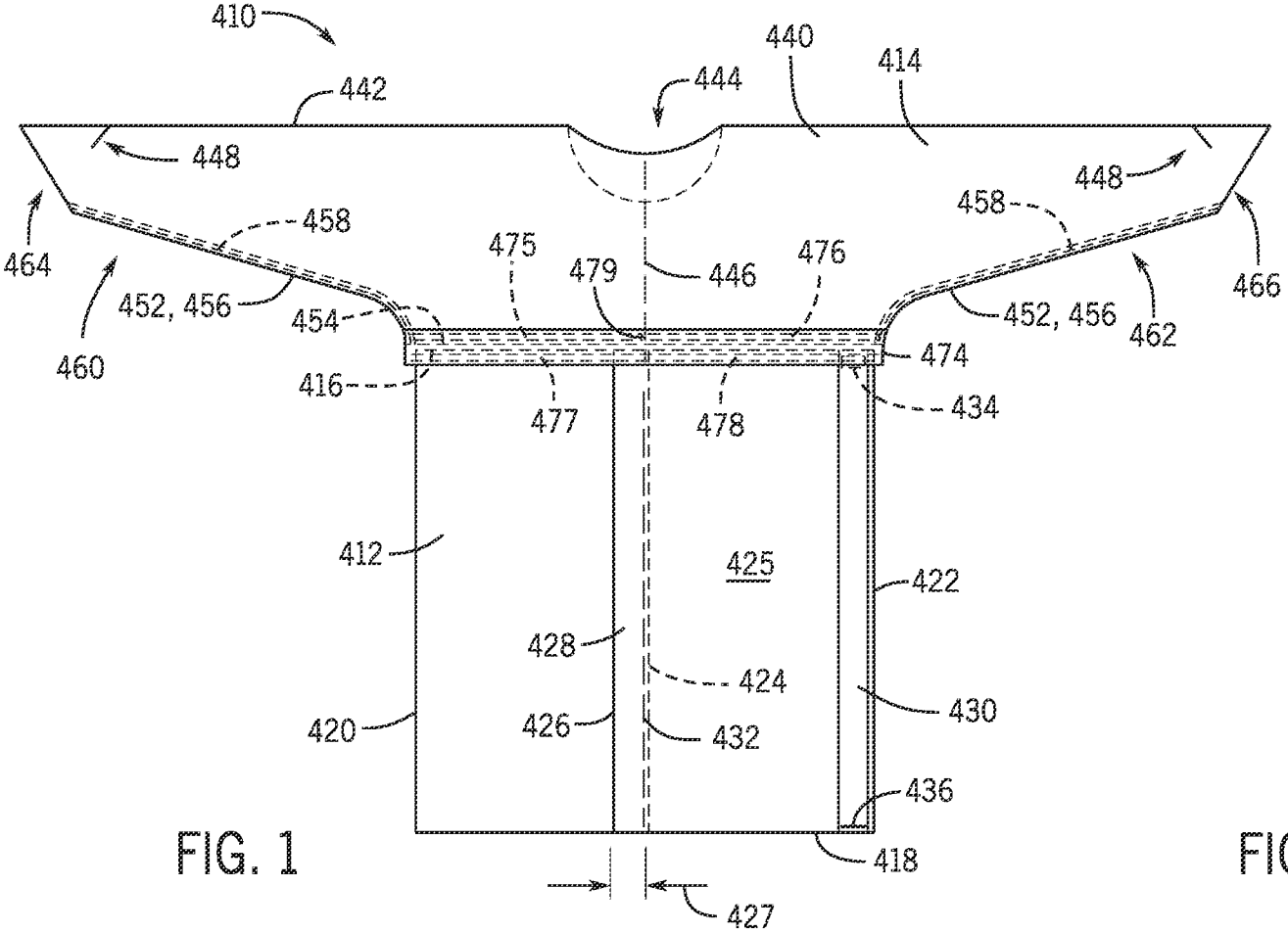
Figure 3:
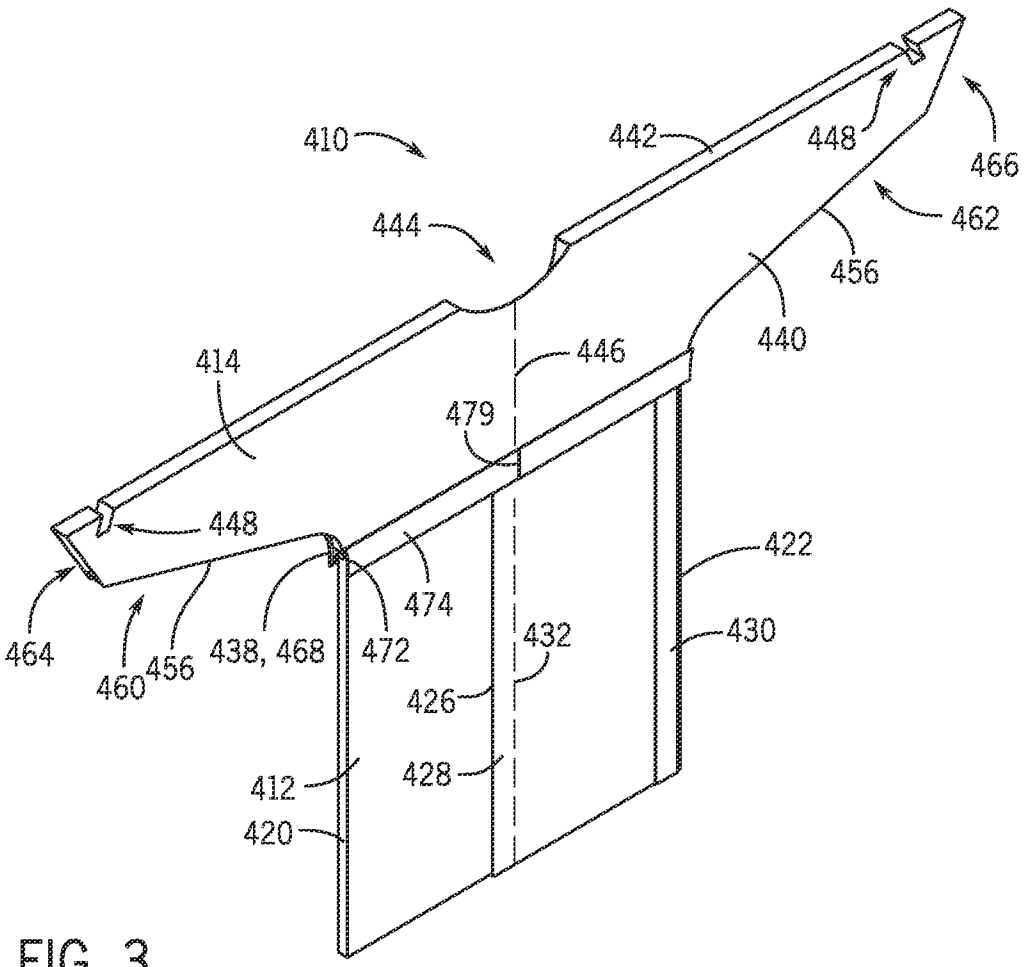

Referring to FIGS. 1-3, rear, right side, and rear perspective views of a multi-piece closed-back isolation gown 410 is shown, according to an embodiment of the invention. Isolation gown 410 includes a torso web piece 412 and a shoulder web piece 414. Torso and shoulder web pieces 412, 414 may include nonwoven materials, woven materials, films, foams, and/or composites or laminates of any of these material types. In FIGS. 1-3, torso web piece 412 is shown as a single torso web panel that has been folded. Folded torso web piece 412 includes a top edge 416, a bottom edge 418, folded left side and right side edges 420, 422, and overlapping left and right side panel edges 424, 426, where panel edges 424, 426 are named for their locations prior to folding torso web piece 412. Edges 416, 418, 420, 422 define front and rear surfaces 423, 425 of torso web piece 412. Right side panel edge 426 is folded over left side panel edge 424 by an overlapping distance 427. However, in various embodiments, left side panel edge 424 may be folded over right side panel edge 426 by overlapping distance 427. In either case, torso web piece 412 has a substantially tubular shape. Further, in other embodiments, torso web piece 412 may also be formed of two separate torso web panels (not shown). In that case, the two torso web panels would be bonded at their side edges to create side seams (not shown). The side seams may be created using a variety of different bonding techniques that attach together two or more material layers such as sonic, thermal, ultrasonic, pressure, or adhesive bonding techniques and various other forms of bonding known in the industry.

Torso web piece 412 further includes two optional tie straps 428, 430. Tie strap 428 is positioned along right side panel edge 426. When in use, tie strap 428 will be separated from torso web piece 412 along perforation line 432, but remain integrated with torso web piece 412 adjacent top edge 416. Tie strap 430 is positioned on rear surface 425 of torso web piece 412 along folded right side edge 422 and is coupled to rear surface 425 via top and bottom adhesive strips 434, 436 adjacent to folded right side edge 422 and may be a strip of web material cut from torso web piece 412 before folding. When in use, tie strap 430 will be separated from torso web piece 412 at bottom adhesive strip 436 and remain connected to torso web at top adhesive strip 434. Bottom adhesive strip 436 may be omitted in some embodiments. Tie straps 428, 430 may be tied around a wearer of isolation gown 410 in order to keep isolation gown 410 close to the wearer and further prevent contact with possibly unsafe substances.

Shoulder web piece 414 of isolation gown 410 includes overlapping front and rear shoulder web panels 438, 440. In isolation gown 410 of FIGS. 1-3, front and rear shoulder web panels 438, 440 share a folded top edge 442. However, front and rear shoulder web panels 438, 440 may also be discrete shoulder web panels with separate top edges (not shown). In that case, shoulder web piece 414 would include a seam (not shown) between shoulder web panels 438, 440 adjacent the two top edges. The seam between the two top edges may be created by a bonding technique such as, for example, sonic, thermal, ultrasonic, pressure, or adhesive bonding. Regardless, top edge 442 includes a substantially centralized neck opening 444.

Shoulder web piece 414 may also include one or more perforation line(s) 446 that extend down from neck opening 444 on rear shoulder web panel 440 such that a wearer of isolation gown 10 is able to tear apart a portion of rear shoulder web panel 440 to make neck opening 444 larger or to completely tear rear shoulder web panel 440 apart. Tearing apart rear shoulder web panel 440 may aid wearer in removing isolation gown 410 without being contaminated by a substance that landed on isolation gown 410 during a medical procedure or industrial activity, as non-limiting examples. A larger neck opening 444 may make a wearer more comfortable while wearing isolation gown 410. In addition, shoulder web piece 414 may also include optional thumb slits or holes 448, referred to hereafter as thumb openings 448, along top edge 442 in order to allow wearers of isolation gown 410 to insert their thumbs therethrough and have greater control over the movement of isolation gown 410.

Front shoulder web panel 438 includes a front bottom edge 450 and two front underarm edges 452 extending from front bottom edge 450 toward top edge 442, and rear shoulder web panel 440 includes a rear bottom edge 454 and two rear underarm edges 456 extending from rear bottom edge 454 toward top edge 442 in approximately the same pattern as front underarm edges 452. Shoulder web piece 414 includes underarm seams or bond patterns 458 joining front and rear shoulder web panels 438, 440 at adjacent front and rear underarm edges 452, 456 in order to create left and right sleeves 460, 462 having respective left and right wrist openings 464, 466 defined between underarm seams 458 and top edge 442. Underarm seams 458 may be created by a bonding technique such as sonic, thermal, ultrasonic, pressure, or adhesive bonding, as non-limiting examples.

Front and rear underarm edges 452, 456 are substantially aligned with each other and joined to one another by bond patterns 458. However, front bottom edge 450 is offset from rear bottom edge 454. That is, front bottom edge 450 is farther away from top edge 442 than rear bottom edge 454. The offset between front bottom edge 450 and rear bottom edge 454 creates an area 468 on an interior surface 470 of front shoulder web panel 438 that is uncovered by second shoulder web panel 440 where torso web piece 412 is attached to front shoulder web panel 438 by an adhesive strip 472. That is, torso web piece 412 is positioned on front shoulder web panel 438 such that top edge 416 of torso web piece 412 extends beyond and overlaps front bottom edge 450 and adhesive strip 472, but is positioned adjacent and does not overlap rear bottom edge 454.

Isolation gown 410 further includes a cover strip segment 474, which may be formed of the same types of material as torso and shoulder web pieces 412, 414. Cover strip segment 474 includes upper adhesive strips 475, 476 and lower adhesive strips 477, 478 positioned thereon. Cover strip segment 474 is positioned over rear shoulder web panel 440 and rear surface 425 of torso web piece 412 such that upper adhesive strip 476 bonds cover strip segment 474 to rear shoulder web panel 440 and lower adhesive strip 478 bonds cover strip segment 474 to rear surface 425 of torso web piece 412. In other words, cover strip segment 474 is used to couple together rear shoulder web panel 440 of shoulder web piece 414 and rear surface 425 of torso web piece 412. Additionally, cover strip segment 474 may optionally include a perforation line 479 formed as an extension of perforation line 446 in rear shoulder web panel 440 to aid a wearer of isolation gown 410 in removing isolation gown 410.

Figure 4:
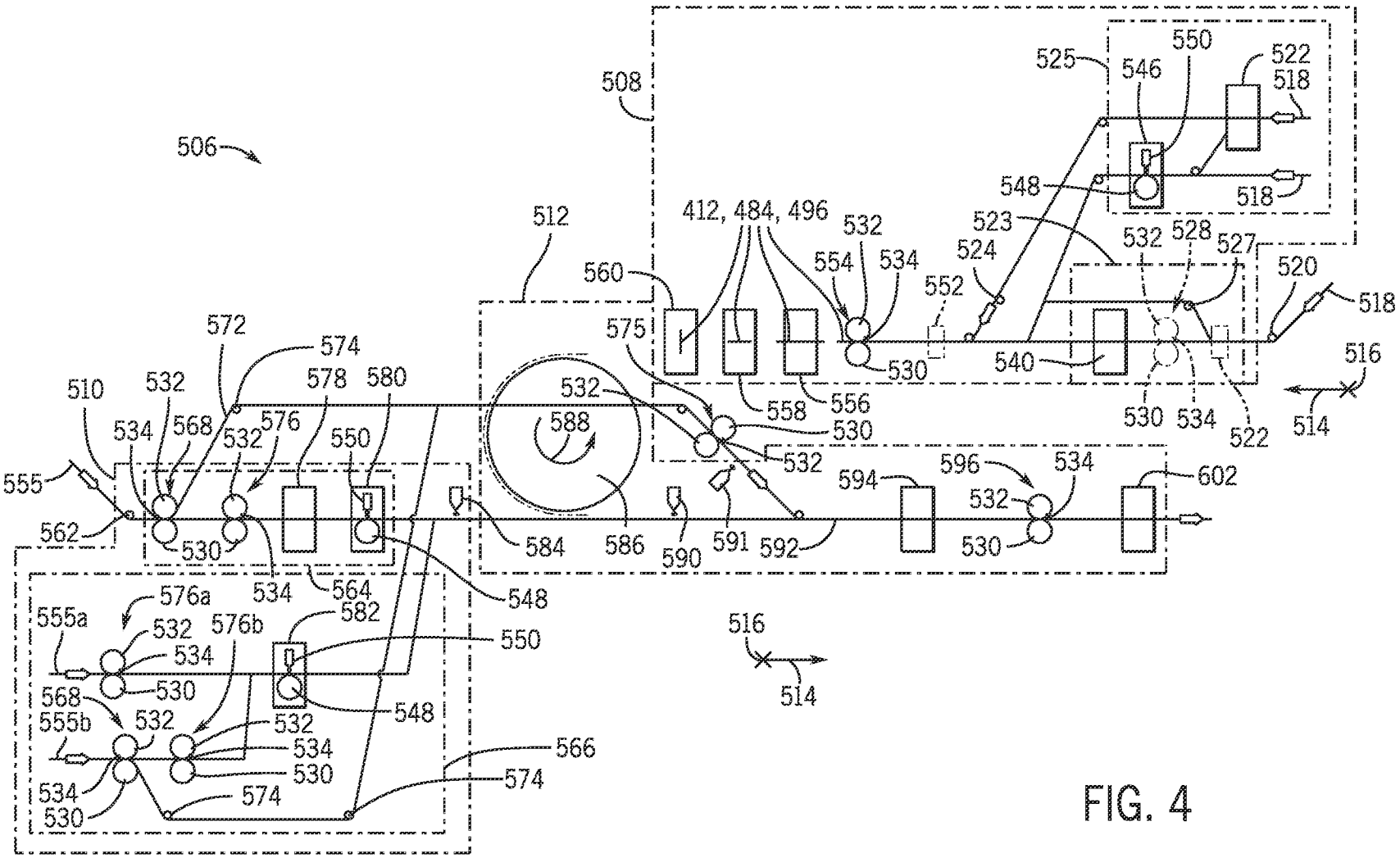
FIG. 4 is a schematic view of a portion of a manufacturing line for forming the multi-piece closed-back isolation garment of FIGS. 1-3, according an embodiment of the invention.
Figure 5:
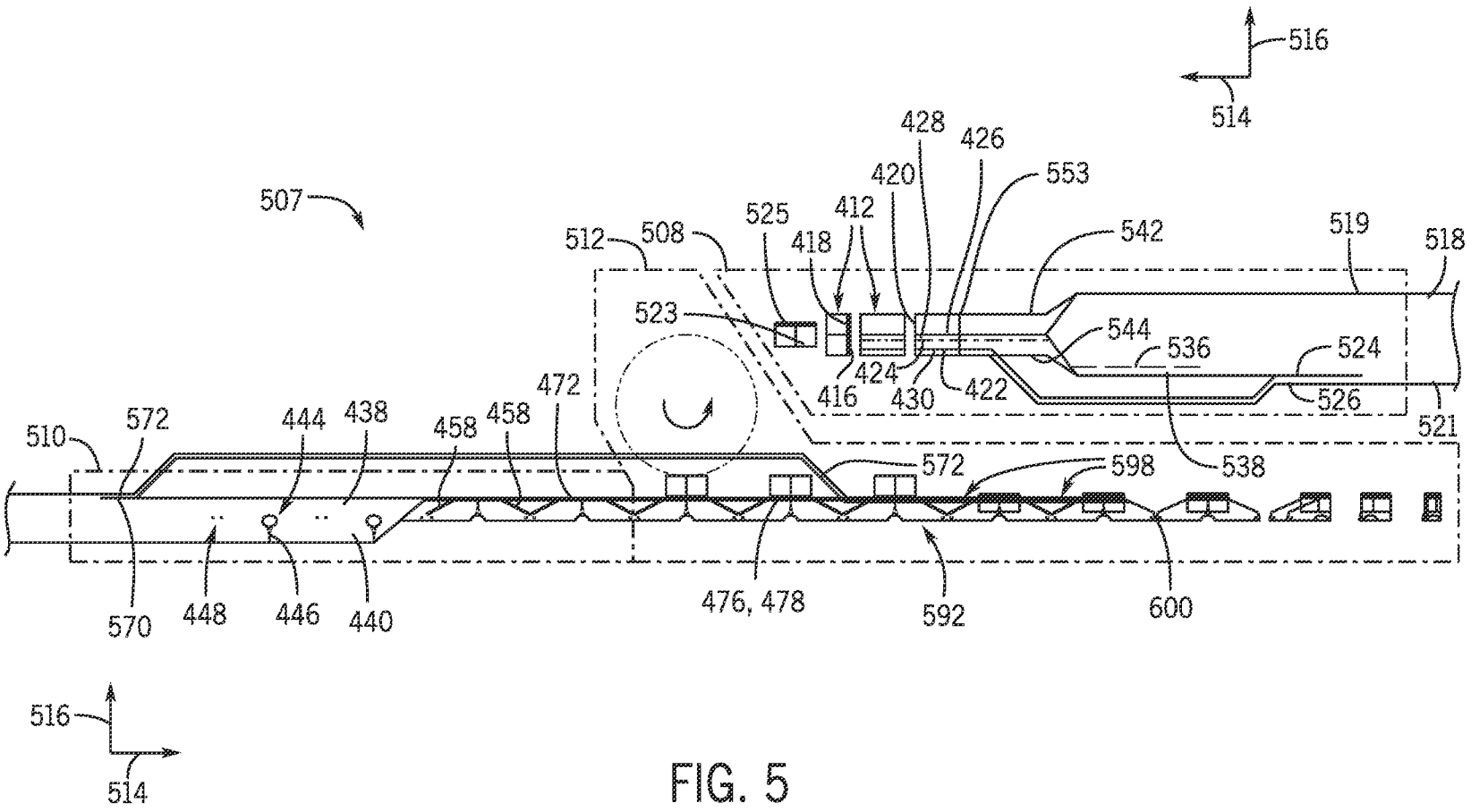
FIG. 5 is a schematic view of a production flow for forming the multi-piece closed-back isolation garment of FIGS. 1-3, according an embodiment of the invention.

Referring now to FIGS. 4 and 5, portions of an exemplary manufacturing line 506 for manufacturing multi-piece closed-back isolation gowns and associated production flow 507 is illustrated, according to an embodiment of the invention. FIG. 4 illustrates the machinery in manufacturing line 506 for performing a method of manufacturing multi-piece closed-back isolation gowns such as, for example, isolation gown 410 of FIGS. 1-3. The production flow 507 of FIG. 5 illustrates how webs may be manipulated and combined into multi-piece closed-back isolation gown 410 of FIGS. 1-3 in manufacturing line 506. As such, like elements in FIGS. 1-3 are numbered identically to corresponding elements in FIGS. 4 and 5.

Manufacturing line 506 includes a torso web piece section 508 that forms torso web pieces 412, a shoulder web piece section 510 that forms shoulder web pieces 414, and an isolation gown section 512 that forms multi-piece closed-back isolation gown 410 from torso web piece 412 and shoulder web piece 414. In general, manufacturing line 506 performs operations along a machine direction 514, but also performs operations in a cross-machine direction 516 that is perpendicular to machine direction 514. In order to facilitate the formation of torso web pieces 412 at least one continuous torso web 518 including a continuous left side panel edge 519 and a continuous right side panel edge 521 is fed into torso web piece section 508 in machine direction 514. Continuous torso web 518 may be fed into torso web piece section 508 via a turnbar infeed process during which continuous torso web 518 is unwound from a roll (not shown) and directed past at least one roller 520. Torso web piece section 508 will be in one of two configurations 523, 525 for processing continuous torso webs 518. In configuration 523, a single continuous torso web 518 is provided and folded. In configuration 518, two separate continuous torso webs 518 are provided and bonded together.

Initially, regarding configuration 523, continuous torso web 518 is directed to an optional slitting unit 522. Slitting unit or apparatus 522 may include one or more knives or slitters (not shown) configured to cut at least one slit 524 in continuous torso web 518 in order to create one or more separated continuous tie strap webs 526 from continuous torso web 518. Thereafter, each separated continuous tie strap web 526 is directed away from continuous torso web 518 via one or more tie strap roller(s) 527. In alternative embodiments, continuous tie strap web 526 may be fed via a material roll (not shown) separate from continuous torso web 518, in which case slitting unit 522 may be omitted. Meanwhile, continuous torso web 518 may pass through an optional perforation unit or apparatus 528 including a rotary anvil 530 aligned with a rotary knife roll 532 having one or more knives 534. Each knife 534 may be positioned within an insert (not shown) on rotary knife roll 532 and arranged to align with a corresponding insert (not shown) inset within rotary anvil 530 during operation of perforation unit 528. Perforation unit 528 may include an ultrasonic assembly in lieu of knife roll 532 to create areas of weakness in the material in an alternative embodiment. Perforation unit 528 may be included in order to cut one or more perforation lines 536 in continuous torso web 518 in order to define one or more integral continuous tie strap webs 538. When continuous torso web 518 is cut later on in torso web piece section 508, perforation lines 536 may become perforation line 432 in FIGS. 1 and 3.

Once separated continuous tie strap webs 526 and integral continuous tie strap webs 538 have been formed, continuous torso web 518 is directed to a folding unit 540. Folding unit 540 may include belts, rotary wheels, discs, rollers, fixed rods or plates of various shapes (flat or three-dimensional) and/or other known folding technologies and is configured to fold continuous torso web 518 in cross-direction 516 at each of continuous left and right side panel edges 519, 521 such that continuous right side panel edge 521 is folded over continuous left side panel edge 519, as shown in FIG. 5. In other words, folding over continuous left side panel edge 519 occurs before folding over continuous right side panel edge 521. However, in various embodiments, left side panel edge 519 may be folded over right side panel edge 521. Regardless, in folding continuous torso web 518, continuous folded left and right side edges 542, 544 are formed.

If configuration 525 of torso web piece section 508 is used in manufacturing line 506 instead of configuration 523, torso web piece section 508 will receive two continuous torso webs 518*a*, 518*b* in machine direction 514. Since configuration 525 utilizes two continuous torso webs 518*a*, 518*b* rather than a single continuous torso web 518, continuous torso webs 518*a*, 518*b* may be much narrower than continuous torso web 518 such as, for example, approximately half the width of continuous torso web 518. Like continuous torso web 518 in configuration 523, continuous torso web 518*a* may be directed to an optional slitting unit 522 including more knives or slitters (not shown) configured to cut at least one slit 524 in continuous torso web 518*a* in order to create one or more separated continuous tie strap webs 526 from continuous torso web 518*a*. Thereafter, each separated continuous tie strap web 526 is directed away from continuous torso web 518*a* via one or more tie strap roller(s) 527.

Continuous torso web 518*a* is laid over continuous web 518*b*, and continuous torso webs 518*a*, 518*b* pass through a bonding unit or apparatus 530. In FIG. 4, bonding unit 530 is shown as an ultrasonic bonding unit 546 including a rotary anvil 548 and an ultrasonic fixed blade horn or sonotrode 550 that cooperate to create side seams (not shown) in continuous torso webs 518*a*, 518*b*. However, bonding unit 546 may alternatively include components for creating the side seams via a different bonding technique such as, for example, sonic, thermal, pressure, or adhesive bonding techniques or various other forms of bonding known in the industry. After passing through bonding unit 546, bonded continuous torso webs 518*a*, 518*b* are referred to as continuous torso web 518.

Regardless of whether torso web piece section 508 includes configuration 523 or configuration 525, the resulting continuous torso web 518 is directed to a tie strap attachment unit or apparatus 552. Tie strap attachment unit 552 is configured to apply adhesive to continuous torso web 518 and place any continuous tie strap webs 526 onto the adhesive to attach continuous tie strap webs 526 to continuous torso web 518. Thereafter, continuous torso web 518 passes through a cutting unit or apparatus 554, such as a rotary die, knife roll with rotary anvil, laser technology, ultrasonic technology, or other known cutting means, for cutting discrete torso web pieces from continuous torso web 518 at a cut line 553, as shown in FIG. 5. As a non-limiting example, these discrete torso web pieces may be in the form of torso web pieces 412 of FIGS. 1-3, as shown in FIG. 5. Cutting unit 554 is shown in FIG. 4 with the same components as perforation unit 528 including rotary anvil 530 aligned with rotary knife roll 532 having one or more knives 534. However, in cutting unit 554, each knife 534 on rotary knife roll 532 is configured to completely separate discrete torso web pieces 412, 484, 496 rather than create perforation lines.

After discrete torso web pieces 412 are cut from continuous torso web 518, discrete torso web pieces 412 may be processed by a number of optional units or apparatus to fold and/or rearrange discrete torso web pieces 412 for placement onto a continuous shoulder web 555. More specifically, torso web piece section 508 may include an optional re-pitching unit or apparatus 556 configured to create a gap between adjacent discrete torso web pieces 412 in machine direction 514, one or more optional folding units or apparatuses 558 configured to bi-fold or tri-fold discrete torso web pieces 412, and/or an optional rotational unit or apparatus 560 configured to rotate discrete torso web pieces 412 by approximately 90 degrees, as shown in FIG. 5 as a non-limiting example. Alternatively, the re-pitching, folding, and rotating of discrete torso web pieces 412 may be performed by a single unit or apparatus, as discussed in more detail below with respect to isolation gown section 512. In yet other embodiments, re-pitching unit 556 may be positioned downstream of folding unit(s) 558 such that the folding operation is performed prior to re-pitching.

As shown in FIGS. 4 and 5, shoulder web piece section 510 operates simultaneously with torso web piece section 508. To begin, at least one continuous shoulder web 555 is fed into shoulder web piece section 510 of manufacturing line 506 in machine direction 514. Continuous shoulder web(s) 555 may be fed into shoulder web piece section 510 via a turnbar infeed process during which continuous shoulder web 555 is unwound from a roll (not shown) and directed past at least one roller 562. Shoulder web piece section 510 will be in one of two different configurations 564, 566 for processing continuous shoulder webs 555. In configuration 564, a single continuous shoulder web 555 is provided and processed. In alternative configuration 566, two separate front and rear continuous shoulder webs 555*a*, 555*b* are provided, processed, and bonded together.

Initially, regarding configuration 564, continuous shoulder web 555 is directed to a slitting unit or apparatus 568 including rotary anvil 530 and rotary knife roll 532 with one or more knives 534. Slitting unit 568 is configured to form a slit 570 in continuous shoulder web 555 in order to form a continuous cover strip segment 572. When continuous cover strip segment 572 is cut later on in isolation gown section 512, continuous cover strip segment 572 will become a plurality of discrete cover strip segments 474, as shown in FIGS. 1-3. Continuous cover strip segment 572 is then directed away from continuous shoulder web 555 via one or more rollers 574. However, in various embodiments, continuous cover strip segment 572 may be supplied as a separate web or cut from web other than continuous shoulder web 555. If continuous cover strip segment 572 is not cut from continuous shoulder web 555, continuous shoulder web 555 may be narrower. Regardless, an optional perforation unit 575 may be used to create one or more perforation lines 479 (FIGS. 1 and 3) in continuous cover strip segment 572.

Meanwhile, continuous shoulder web 555 is directed to a die and/or perforation unit or apparatus 576 including rotary anvil(s) 530 and rotary knife roll(s) 532 with one or more knives 534. Die and/or perforation unit 576 is configured to cut neck openings 444 in continuous shoulder web 555 and may optionally cut neck perforation line(s) 446 and thumb openings 448 in continuous shoulder web 555, as shown in FIG. 5. In one embodiment, die and/or perforation unit 576 includes a single rotary anvil 530/rotary knife roll 532 pair with knives 534 configured to cut neck openings 444, neck perforation line(s) 446, and thumb openings 448. In such an embodiment, die and/or perforation unit 576 may be cammed to create neck openings 444, neck perforation line(s) 446, and thumb openings 448 at the desired spacing. In an alternate embodiment, die and/or perforation unit 576 includes two or more separate rotary anvil 530/rotary knife roll 532 pairs, spaced in the machine direction 514, for cutting neck openings 444, neck perforation line(s) 446, and thumb openings 448. Any or all of the separate rotary anvil 530/rotary knife roll 532 pairs may be cammed.

Thereafter, continuous shoulder web 555 enters a folding unit 578, which may include belts, rotary wheels, discs, rollers, fixed rods or plates of various shapes (flat or three-dimensional) and/or other known folding technologies. As shown most clearly in FIG. 5, the fold in continuous shoulder web 555 is performed to define front and rear shoulder web panels 438, 440 shown mostly clearly in FIG. 2 with folded top edge 442. As such, the fold created by folding unit 578 is made slightly off-center in in order to create area 468 uncovered by rear shoulder web 440. In an alternative embodiment, folding unit 578 is positioned upstream of the die and/or perforation unit 576 that creates neck openings 444. Once folded, continuous shoulder web 555 passes through a bonding unit or apparatus 580. In FIG. 4, bonding unit 580 is shown as an ultrasonic bonding unit 580 including rotary anvil 548 and sonotrode 550 that cooperate to create underarm seams in continuous shoulder web 555. As shown in FIG. 5, the underarm seams may be, for example, underarm seams 458 of shoulder web piece 414 of FIGS. 1-3. However, bonding unit 580 may alternatively include components for creating the underarm seams via a different bonding technique such as, for example, sonic, thermal, pressure, or adhesive bonding techniques or various other forms of bonding known in the industry.

If configuration 566 of shoulder web piece section 510 is used in manufacturing line 506 instead of configuration 564, shoulder web piece section 510 will receive front and rear continuous shoulder webs 555*a*, 555*b* that are approximately half as wide as continuous shoulder web 555 in configuration 564 (not counting continuous cover strip segment 572). In the same manner as in configuration 564, front and rear continuous shoulder webs 555*a*, 555*b* will pass through separate die and/or perforation units 576*a*, 576*b*, respectively. Die and/or perforation unit 576*a* is configured to create neck openings 444 and/or optional thumb openings 448 in front continuous shoulder web 555*a*. Die and/or perforation unit 576*b* is configured to create neck openings 444 and/or optional perforation line 446 in rear continuous shoulder web 555*b*. Rear continuous shoulder web 555*b* also passes through slitting unit 568 to form a slit 570 in rear continuous shoulder web 555*b* and create continuous cover strip segment 572. Continuous cover strip segment 572 is then directed away from rear continuous shoulder web 555*b* via one or more rollers 574. While FIG. 4 illustrates slitting unit 568 before die and/or perforation unit 576*b*, they may be reversed in various embodiments. Alternatively, in various embodiments, continuous cover strip segment 572 may be supplied as a separate web or cut from a web other than rear continuous shoulder web 555*b*. If continuous cover strip segment 572 is not cut from rear continuous shoulder web 555*b*, rear continuous shoulder web 555*b* may be narrower.

Next, front and rear continuous shoulder webs 555*a*, 555*b* are laid on top of each other and passed through a bonding unit or apparatus 582. Like bonding unit 580 in configuration 564 of shoulder web piece section 510, bonding unit 582 is shown in FIG. 4 as including rotary anvil 548 and sonotrode 550 for performing ultrasonic bonding, but may include equipment for performing another bonding technique such as, for example, sonic, thermal, pressure, or adhesive bonding. However, in addition to creating underarm seams in continuous shoulder webs 555*a*, 555*b*, bonding unit 582 also creates a top seam (not shown) adjacent to top edges (not shown) of continuous shoulder webs 555*a*, 555*b*. The result of the bonding is that the combined front and rear continuous shoulder webs 555*a*, 555*b* are arranged similarly to continuous shoulder web 555 of configuration 564, but with the inclusion of the top seam between front and rear continuous shoulder webs 555*a*, 555*b*. As such, the combined front and rear continuous shoulder webs 555*a*, 555*b* will be referred to as continuous shoulder web 555. After passing through configuration 564 or configuration 566, continuous shoulder web 555 passes by an adhesive applicator 584, which applies adhesive strip 472 in area 468 of front shoulder web panel 438 uncovered by rear shoulder web panel 440 shown in FIG. 2.

As illustrated by FIGS. 4 and 5 after torso web piece section 508 and shoulder web piece section 510 have completed their operations, torso web pieces 412 and continuous shoulder web 555 are provided by torso and shoulder web piece sections 508, 510, respectively, to isolation gown section 512. Continuous cover strip segment 572 is also directed to isolation gown section 512. Isolation gown section 512 includes a torso web piece transfer unit or apparatus 586 configured to transfer discrete torso web pieces 412, 484, 496 in a rotational direction 588 (counterclockwise in FIGS. 4 and 5) such that front surface 425 of each discrete torso web piece 412, 484, 496 is placed onto adhesive strips 472 on continuous shoulder web 555 for attachment to continuous shoulder web 555. Transfer unit 586 may be a separate unit from that of re-pitching unit 556, folding unit 558, and/or rotational unit 560 in the form of a vacuum drum in which a vacuum drawn through holes (not shown) in the vacuum drum carries discrete torso web pieces 412 and transfers them to continuous shoulder web 555. However, transfer unit 586 may be in the form of a unit that takes the place of re-pitching unit 556 and/or rotational unit 558. The unit may be in the form of a cam-based system (not shown) in which a plurality of vacuum pucks (not shown) may re-pitch and/or rotate discrete torso web pieces 412 and place them onto continuous shoulder web 555. The unit may also be a track-based system (not shown) in which a plurality of vacuum pucks (not shown) on a track re-pitch and/or rotate discrete torso web pieces 412 and place them onto continuous shoulder web 555. In the track-based system, the vacuum pucks may be controlled individually by separate drive elements on the track and could then be more easily reconfigured electronically as necessary. In the case where transfer unit 586 is the cam-based or track-based system, discrete torso web pieces 412 may optionally be folded by folding unit 558 before being carried by transfer unit 586. Discrete torso web pieces 412 are folded by folding unit 558 slightly off-center such that bottom edge 418 of each discrete torso web piece 412 is folded toward, but spaced apart from, top edge 416. While FIG. 4. illustrates a single re-pitching unit 556, alternate embodiments may include multiple re-pitching units positioned before and/or after transfer unit 586 to re-pitch the discrete torso web pieces 412 prior to transfer to continuous shoulder web 555.

After discrete torso web pieces 412 are placed onto adhesive strips 472 on continuous shoulder web 555, an adhesive applicator 590 applies adhesive strips 475, 476, 477, 478 onto rear surface 423 of discrete torso web pieces 412 adjacent top edge 416 and, optionally, onto rear shoulder web panel 440 adjacent bottom edge 454. In an alternative embodiment, optional adhesive applicator 591 is provided in place of or in addition to adhesive applicator 590 to apply adhesive strips 475, 476, 477, 478 onto continuous cover strip segment 572. Next, continuous cover strip segment 572 is placed over adhesive strips 475, 476, 477, 478 to bond together torso web pieces 412 and rear shoulder web panels 440. Once discrete torso web pieces 412 and rear shoulder web panels 440 are bonded together, the combined structure may be considered as a continuous isolation garment web, referred to hereafter as continuous isolation gown web 592. Continuous isolation gown web 592 is directed to a folding unit or apparatus 594, which may include belts, rotary wheels, discs, rollers, fixed rods or plates of various shapes (flat or three-dimensional) and/or other known folding technologies. Folding unit 594 (FIG. 4) may fold continuous isolation gown web 592 by folding discrete torso web pieces 412 in cross-machine direction 516 over a portion of continuous shoulder web 555 as shown in FIG. 5. In other embodiments, folding unit 594 may alternatively fold discrete torso web pieces 412 under continuous shoulder web 555 or fold continuous shoulder web 555 over or under discrete torso web pieces 412.

Upon completion of the folding, continuous isolation gown 592 passes through a die unit or apparatus 596 including rotary anvil 530 and rotary knife roll 532 with one or more knives 534. Die unit 596 is configured to cut out excess underarm and cover strip material and wrist cutouts 598 from continuous shoulder web 555 in front and rear shoulder web panels 438, 440 and create underarm edges 452, 456 in front and rear shoulder web panels 438, 440, respectively. Die unit 596 may also be configured to separate continuous isolation gown web 592 into discrete multi-piece closed-back/tube-style isolation gowns 410 including respective torso web pieces 412 and shoulder web pieces 414 at cut lines 600. In the illustrated embodiment die unit 596 is positioned downstream from folding unit 594. In an alternative embodiment, die unit 596 may be positioned upstream of folding unit 594. FIG. 5 illustrates isolation gowns 410 with torso web piece 412 and shoulder web pieces 414, as similarly shown in FIGS. 1-3. Alternatively, die unit 596 may create cut lines 600 as perforation lines 600 when it is desired to package continuous isolation gown web 592 in a roll from which an individual may tear discrete isolation gowns 410 as needed.

Once die unit 596 has removed excess material and wrist cutouts 598 and/or cut continuous isolation gown web 592 into discrete isolation gowns 410, discrete isolation gowns 410 pass through a multi-stage folding unit or apparatus 602. As non-limiting examples, multi-stage folding unit 602 may include multiple folding stations such as, for example, three tuckers (not shown) or multiple pairs of rotating folding blades (not shown) that perform a tri-fold operation on each isolation gown 410 to make them ready for packaging, as shown in FIG. 5. While a tri-fold configuration is described herein, it is contemplated that multi-stage folding unit 602 may be configured to create any number of folds in the isolation gown 410 to create the desired folded product shape for packaging. However, if continuous isolation gown web 592 has not been separated into discrete isolation gowns 410, multi-stage folding unit 602 may instead be a rewinder for rolling up continuous isolation gown web 592 for packaging in an isolation gown web dispenser (not shown) from which discrete isolation gowns 410 may be torn, as described above.

Beneficially, embodiments of the invention include an apparatus and method of manufacturing multi-piece closed-back isolation gowns having a torso web piece and a shoulder web piece. In manufacturing the torso web pieces, either a single continuous torso web is folded or two continuous torso webs are bonded together. In manufacturing the shoulder web pieces, front and rear shoulder web panels are formed by either folding one continuous shoulder web and bonding the overlapping shoulder web layers or by bonding two continuous shoulder webs together. Discrete torso web pieces are cut from a continuous torso web by a cutting unit. A transfer unit transfers the discrete torso web pieces onto the continuous shoulder web such that top edges of the discrete torso web pieces overlap a bottom edge of the front shoulder web panels of the continuous shoulder web with an adhesive strip. Thereafter, a continuous cover strip segment is applied to couple the discrete torso web pieces and continuous shoulder web to form a continuous multi-piece closed-back isolation gown web which may be would into a roll or cut to form discrete isolation gowns for folding and packaging. The manufacturing of the multi-piece closed-back isolation gowns can quickly produce the isolation gowns without manual input and with only a small amount of scrap material. The formation of the torso web pieces does not result in any scrap material, and the formation of the shoulder web pieces results in only minimal scrap material from cutting neck and wrist openings and excess underarm material.

Therefore, according to one embodiment of the invention, an apparatus for manufacturing multi-piece closed-back isolation garments includes a slitting unit configured to cut and separate a continuous cover strip segment from a continuous shoulder web, at least one die unit configured to cut a neck opening in the continuous shoulder web, and a first folding unit configured to fold a second shoulder web panel of a continuous shoulder web over a first shoulder web panel of the continuous shoulder web and create an area on the first shoulder web panel that is uncovered by the second shoulder web panel. The apparatus further includes a first bonding unit configured to bond the first shoulder web panel to the second shoulder web panel, a first adhesive applicator configured to apply a first adhesive strip to the uncovered area of the first shoulder web panel, and a perforation unit configured to cut a perforation line in a continuous torso web to define a first tie strap. In addition, the apparatus includes a second folding unit configured to fold the continuous torso web into a tube, a cutting unit configured to cut a torso web piece from the folded continuous torso web, and a transfer unit configured to transfer a torso web piece having a substantially tubular shape onto the first adhesive strip. The apparatus also includes a second adhesive applicator configured to apply a second adhesive strip to attach the continuous cover strip segment to the torso web piece and second shoulder web panel and forming a continuous isolation garment web and at least one other adhesive applicator configured to attach a second tie strap to the torso web piece of the continuous isolation garment web.

According to another embodiment of the present invention, a method of manufacturing multi-piece closed-back isolation garments includes slitting a continuous cover strip segment from a continuous shoulder web using a slitting unit, cutting neck openings in the continuous shoulder web using a die unit, and overlapping first and second shoulder web panels of the continuous shoulder web to create an area in the first shoulder web panels that is uncovered by the second shoulder web panel. Furthermore, the method includes bonding the first and second shoulder web panels with a first bonding unit, applying a first adhesive strip on the continuous shoulder web in the uncovered area of the first shoulder web panel, and cutting a perforation line in the continuous torso web to define an integrated continuous tie strap. The method also includes folding a continuous torso web to form a tube, cutting a torso web piece from the folded continuous torso web, and transferring, with a transfer unit, a torso web piece having a substantially tubular shape onto the first adhesive strip such that a top edge of the torso web piece overlaps the bottom edge of the first shoulder web panel. Additionally, the method includes attaching the continuous cover strip segment to the torso web piece and second shoulder web panel with a second adhesive strip to form a continuous isolation garment web and adhesively attaching a second tie strap to the torso web piece of the continuous isolation garment web.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description but is only limited by the scope of the appended claims.

What is claimed is:

1. An apparatus for manufacturing multi-piece closed-back isolation garments, the apparatus comprising:

a slitting unit configured to cut and separate a continuous cover strip segment from a continuous shoulder web;

at least one die unit configured to cut a neck opening in the continuous shoulder web;

a first folding unit configured to fold a second shoulder web panel of the continuous shoulder web over a first shoulder web panel of the continuous shoulder web and create an area on the first shoulder web panel that is uncovered by the second shoulder web panel;

a first bonding unit configured to bond the first shoulder web panel to the second shoulder web panel;

a first adhesive applicator configured to apply a first adhesive strip to the uncovered area of the first shoulder web panel;

a perforation unit configured to cut a perforation line in a continuous torso web to define a first tie strap;

a second folding unit configured to fold the continuous torso web into a tube;

a cutting unit configured to cut a torso web piece from the folded continuous torso web;

a transfer unit configured to transfer the torso web piece having a substantially tubular shape onto the first adhesive strip;

a second adhesive applicator configured to apply a second adhesive strip to attach the continuous cover strip segment to the torso web piece and second shoulder web panel and forming a continuous isolation garment web; and at least one other adhesive applicator configured to attach a second tie strap to the torso web piece of the continuous isolation garment web.

2. The apparatus of claim 1 wherein the at least one other adhesive applicator is configured to attach the second tie strap to the torso web piece with an adhesive strip positioned proximate a first end of the second tie strap and another adhesive strip positioned proximate a second end of the second tie strap.

3. The apparatus of claim 1 further comprising:

a slitting unit configured to create a slit in the continuous torso web to form a separated continuous tie strap; and a cutting unit configured to cut the second tie strap from the separated continuous tie strap.

4. The apparatus of claim 1 wherein the perforation unit is configured to create the perforation line in the continuous torso web adjacent a first side edge of the continuous torso web to define an integrated continuous tie strap.

5. The apparatus of claim 4 wherein the perforation unit is positioned upstream of the second folding unit.

6. The apparatus of claim 1 further comprising a second bonding unit configured to join together first and second continuous torso webs to form the continuous torso web; and a cutting unit configured to cut the torso web pieces from the continuous torso web.

7. The apparatus of claim 6 further comprising:

a slitting unit configured to slit and separate a continuous tie strap from one of the first and second continuous torso webs; and a cutting unit configured to cut the second tie strap from the continuous tie strap.

8. The apparatus of claim 1 further comprising a cutting unit configured to cut discrete multi-piece closed-back isolation garments from the continuous isolation garment web.

9. The apparatus of claim 1 wherein the transfer unit is configured to repatch and rotate the torso web piece while transferring the torso web piece.

10. The apparatus of claim 1 wherein the at least one die unit is further configured to cut at least one neck perforation line in the continuous shoulder web.

11. The apparatus of claim 1 wherein the at least one die unit is configured to cut a neck perforation line that extends from the neck opening toward an edge of the continuous shoulder web.

12. The apparatus of claim 1 wherein the at least one die unit is configured to cut thumb openings in the continuous shoulder web.

13. A method of manufacturing multi-piece closed-back isolation garments, the method comprising:

slitting a continuous cover strip segment from a continuous shoulder web using a slitting unit;

cutting neck openings in the continuous shoulder web using a die unit;

overlapping first and second shoulder web panels of the continuous shoulder web to create an area in the first shoulder web panel that is uncovered by the second shoulder web panel;

bonding the first and second shoulder web panels with a first bonding unit;

applying a first adhesive strip on the continuous shoulder web in the uncovered area of the first shoulder web panel;

cutting a perforation line in a continuous torso web to define an integrated continuous tie strap;

folding the continuous torso web to form a tube;

cutting a torso web piece from the folded continuous torso web;

transferring, with a transfer unit, the torso web piece having a substantially tubular shape onto the first adhesive strip such that a top edge of the torso web piece overlaps the bottom edge of the first shoulder web panel;

attaching the continuous cover strip segment to the torso web piece and second shoulder web panel with a second adhesive strip to form a continuous isolation garment web; and adhesively attaching a second tie strap to the torso web piece of the continuous isolation garment web.

14. The method of claim 13 further comprising cutting the continuous isolation garment web with a cutting unit to form discrete multi-piece closed-back isolation garments.

15. The method of claim 13 further comprising forming the torso web piece by folding, with a folding unit, a continuous torso web having a first side edge and a second side edge opposite the first side edge such that the first and second side edges of the continuous torso web overlap each other.

16. The method of claim 15 further comprising cutting the perforation line in the continuous torso web before folding the continuous torso web such that the torso web piece cut includes the integrated continuous tie strap.

17. The method of claim 15 wherein forming the torso web piece further comprises:

slitting a continuous tie strap from the continuous torso web with a slitting unit before folding the continuous torso web; and cutting the continuous tie strap to create the second tie strap.

18. The method of claim 17 wherein the continuous shoulder web is a single continuous shoulder web; and wherein overlapping the first and second shoulder web panels in the continuous shoulder web comprises folding the first shoulder web panels over the second shoulder web panels.

19. The method of claim 13 wherein the continuous shoulder web comprises a first continuous shoulder web including the first shoulder web panel and a second continuous shoulder web including the second shoulder web panel; and wherein overlapping the first and second shoulder web panels in the continuous shoulder web comprises laying the first continuous shoulder web over the second continuous shoulder web.

20. The method of claim 13 further comprising forming thumb openings in the continuous shoulder web.

* * * * *